US006339212B1

(12) United States Patent
Campbell

(10) Patent No.: US 6,339,212 B1
(45) Date of Patent: Jan. 15, 2002

(54) COOKING APPLIANCE HAVING CONTROLS COOLED BY NATURAL CONVECTION AND METHOD OF COOLING THE SAME

(75) Inventor: Robert P. Campbell, Sacramento, CA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/670,450

(22) Filed: Sep. 26, 2000

(51) Int. Cl.[7] ..... H05B 3/68
(52) U.S. Cl. ..... 219/460.1; 219/412.11
(58) Field of Search ..... 219/450.1, 451.1, 219/452.11, 452.12, 460.1, 461.1, 462.1; 126/393, 39 K, 90 A, 92 A, 211, 21 R, 21 A

(56) References Cited

U.S. PATENT DOCUMENTS

| | | | | | |
|---|---|---|---|---|---|
| 3,627,986 | A | * | 12/1971 | Anderson | 219/452.12 |
| 3,870,862 | A | * | 3/1975 | Doner | 219/452.12 |
| 4,216,370 | A | * | 8/1980 | Charvat | 219/452.11 |
| 5,467,251 | A | * | 11/1995 | Katchmar | 361/719 |
| 5,717,189 | A | * | 2/1998 | Goetz et al. | 219/445.1 |
| 6,201,221 | B1 | * | 3/2001 | LaGrotta et al. | 219/483 |

* cited by examiner

*Primary Examiner*—Sang Paik
(74) *Attorney, Agent, or Firm*—Pierce Atwood

(57) ABSTRACT

Improved cooling is achieved in a cooking appliance including a burner box having at least one burner assembly disposed therein. A control box containing control electronics is spaced below the burner box so that a gap is created between the burner box and the control box. A plurality of fins is formed on at least one wall of the control box for cooling the control electronics by natural convection.

23 Claims, 2 Drawing Sheets

COOKING APPLIANCE HAVING CONTROLS COOLED BY NATURAL CONVECTION AND METHOD OF COOLING THE SAME

BACKGROUND OF THE INVENTION

This invention relates generally to cooking appliances such as cooktops and ranges and more particularly to cooling the control electronics in such appliances.

Modern cooking appliances increasingly incorporate electronic control systems for controlling operation of the appliance. These control electronics are ordinarily contained in a separate control box located in close proximity to the heating elements of the cooking appliance. In many cases, these control electronics need to be protected from the high temperatures generated by the cooking appliance. The control electronics are also typically cooled in some manner to protect them from the heat generated by the control electronics themselves, particularly the portion of the electronics involved in power control.

In many conventional cooking appliances, the control electronics are cooled by forced convection, typically a fan arranged to blow cooling air over the control electronics. However, the use of a fan is often undesirable because of the noise associated with a running fan. Furthermore, fans can add to the overall cost of the appliance and typically carry a relatively high service call rate.

Accordingly, it is desirable to provide a cooking appliance in which the control electronics are cooled by means other than forced convection.

BRIEF SUMMARY OF THE INVENTION

The above-mentioned need is met by the present invention, which provides a cooking appliance including a burner box having at least one burner assembly disposed therein and a control box containing control electronics. The control box is spaced below the burner box so that a gap is created between the burner box and the control box, and a plurality of fins is formed on at least one wall of the control box for cooling the control electronics by natural convection.

The present invention and its advantages over the prior art will become apparent upon reading the following detailed description and the appended claims with reference to the accompanying drawings.

BRIEF DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
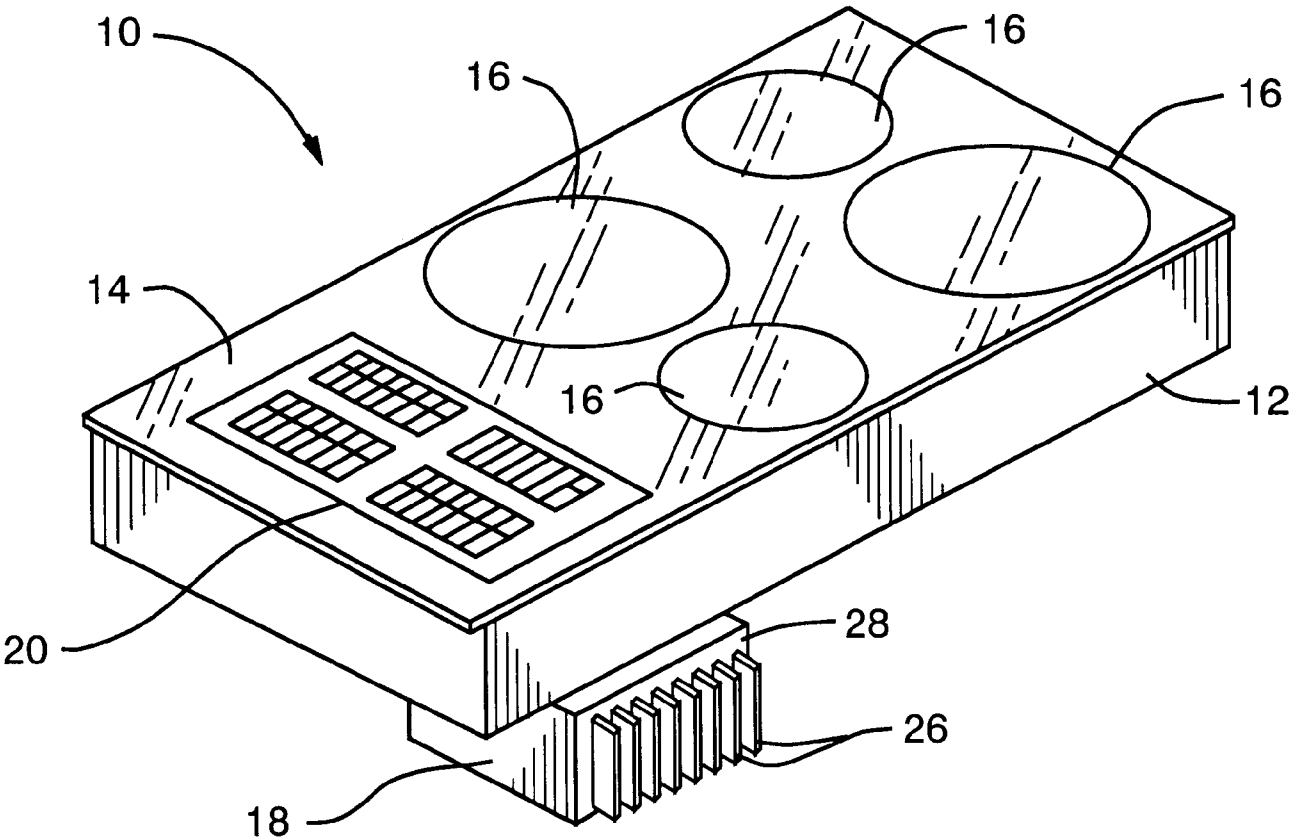
FIG. 1 is a perspective view of a cooking appliance having a burner box and a control box.

Referring to the drawings wherein identical reference numerals denote the same elements throughout the various views, FIG. 1 shows a cooking appliance 10 having a housing or burner box 12 and a glass-ceramic plate 14 disposed on top of the burner box 12 to provide a cooking surface. Located directly underneath the plate 14 is a number (typically, but not necessarily, four) of burner assemblies (not shown). Circular patterns 16 formed on the cooking surface of the plate 14 identify the position of each burner assembly. A control box 18 is located below the burner box 12. The control box 18 contains control electronics (not shown), which are generally known in the art and control the operation of the appliance 10. A control panel 20 is provided on the plate 14. As is known in the field, the control panel 20 includes touch pads, knobs or the like that allow a user of the appliance 10 to interface with the control electronics and individually control the temperature of the burner assemblies.

The control electronics can be any type known in the art. Cooking appliances generally include a power source (typically a standard 240 volt, 60 Hz AC power source) that is coupled to the heating elements of the burner assemblies for supplying power thereto. A power source control means such as a triac is provided for each burner assembly to regulate the level of power delivered to the corresponding heating element. A triac is a conventional semiconductor device capable of conducting current in either direction across its main terminals when triggered by either a positive or negative voltage applied to its gate terminal. An electronic controller supplies the gate signal. The controller controls the power applied to the heating element by controlling the rate at which gate signals are applied to the triac gate terminal. The gate signal pulse rate is dictated by the power setting selections for the burner assembly entered by user actuation of the control panel 20.

The cooking appliance 10 shown in FIG. 1 is the type of cooking appliance, commonly referred to as a cooktop, that is designed to be mounted into a countertop. However, it should be noted that the present invention is not limited to cooktops, but is also applicable to other types of cooking appliances such as ranges. Furthermore, the present invention is not limited to glass-ceramic cooking appliances, as it is equally applicable to cooking appliances without glass-ceramic surfaces.

Figure 2:
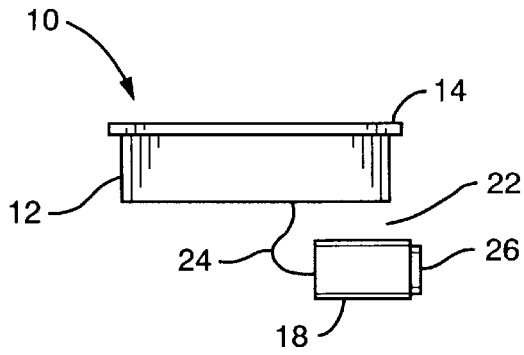
FIG. 2 is a side view of the cooking appliance of FIG. 1.

Referring now to FIG. 2, it is seen that the control box 18 is spaced below the burner box 12 such that an air gap 22 is created between the bottom of the burner box 12 and the top of the control box 18. The air gap 22 acts as a thermal barrier between the burner box 12 and the control box 18 that impedes heat transfer from the burner box 12 to the control box 18, and thus to the control electronics. Optionally, a layer of thermal insulation could be placed in the air gap 22 to further resist heat transfer. The control electronics in the control box 18 are electrically connected to the appropriate components in the burner box 12 by suitable wiring, represented collectively in FIG. 2 by a cable 24.

Figure 3:
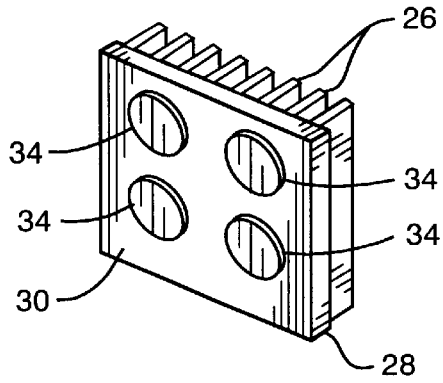
FIG. 3 is a perspective view of one wall of the control box of FIG. 1.
Figure 4:
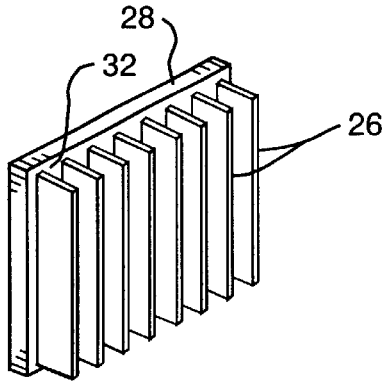
FIG. 4 is another perspective view of the control box wall shown in FIG. 3.

The control box 18 includes a plurality of exterior fins 26 for dissipating heat generated by the control electronics themselves. In one embodiment, the fins 26 are formed on one of the six walls of the control box 18, which wall is referred to herein as the heat sink wall and identified by reference numeral 28. As best seen in FIGS. 3 and 4, the heat sink wall 28 has an interior side 30 and an exterior side 32, on which the fins 26 are formed. The heat sink wall 28 is a relatively thick piece made of a material, such as aluminum, that has a high thermal conductivity. Thus, the heat sink wall 28 has a large capacity to absorb heat from the control electronics in the control box 18. In one preferred embodiment, the heat sink wall 28 is thicker than the other walls of the control box 18. For example, the heat sink wall 28 can have a thickness on the order of about 0.25–0.50 inches (0.635–1.27 cm).

The fins 26 formed on the exterior side 32 of the heat sink wall 28 promote dissipation of the absorbed heat to the ambient by natural convection. The fins 26 can be integrally formed on the heat sink wall 28; that is, the fins 26 and the heat sink wall 28 comprise a single piece of material having a high thermal conductivity. The open space above the control box 18 due to the air gap 22 provides sufficient room for air to circulate through the fins 26. Furthermore, the control box 18 is located with respect to the burner box 12 such that the fins 26 extend laterally beyond the side of the burner box 12, as seen best in FIG. 2. The fins 26 are preferably, but not necessarily, arranged vertically to further promote air circulation.

To enhance heat transfer from the control electronics to the heat sink wall 28, the control electronics can be directly mounted to the interior side 30. For example, FIG. 3 shows a plurality triacs 34 (i.e., the power control electronics) mounted to the interior side 30 of the heat sink wall 28. Thus, heat generated by the triacs 34 during operation will be transferred to the heat sink wall 28 by conduction.

The foregoing has described a cooking appliance in which the control electronics are disposed in a finned control box that is spaced below the appliance's burner box. Thus, the control electronics are located away from the heat generated by the cooking appliance, and the heat generated by the control electronics themselves is dissipated using natural convection. This avoids the cost and noise associated with forced convection cooling.

While specific embodiments of the present invention have been described, it will be apparent to those skilled in the art that various modifications thereto can be made without departing from the spirit and scope of the invention as defined in the appended claims.

What is claimed is:

1. A cooking appliance comprising:

a burner box having at least one burner assembly disposed therein;

a control box spaced below said burner box so that a gap is created between said burner box and said control box, said control box containing control electronics; and a plurality of fins formed on one wall of said control box for cooling said control electronics by natural convection.

2. The cooking appliance of claim 1 wherein said control electronics are mounted on said one wall.

3. The cooking appliance of claim 1 wherein said control electronics include power control electronics, said power control electronics being mounted on said one wall.

4. The cooking appliance of claim 1 wherein said control box is located with respect to said burner box so that said fins extend laterally beyond said burner box.

5. The cooking appliance of claim 1 wherein said fins are arranged vertically on said one wall.

6. The cooking appliance of claim 1 wherein said fins are integrally formed on said one wall.

7. The cooking appliance of claim 6 wherein said fins and said one wall are made of a material having a high thermal conductivity.

8. The cooking appliance of claim 7 wherein said fins and said one wall are made of aluminum.

9. The cooking appliance of claim 1 wherein said one wall is thicker than other walls of said control box.

10. The cooking appliance of claim 9 wherein said one wall is made of a material having a high thermal conductivity.

11. The cooking appliance of claim 10 wherein said one wall is made of aluminum.

12. A cooking appliance comprising:

a burner box having at least one burner assembly disposed therein;

a control box spaced below said burner box so that a gap is created between said burner box and said control box, said control box containing control electronics and comprising a plurality of walls, wherein a first one of said walls is thicker than the other ones of said walls and has an interior side and an exterior side; and a plurality of fins formed on said exterior side of said first wall for cooling said control electronics by natural convection.

13. The cooking appliance of claim 12 wherein said control electronics are mounted on said interior side of said first wall.

14. The cooking appliance of claim 12 wherein said control electronics include power control electronics, said power control electronics being mounted on said interior side of said first wall.

15. The cooking appliance of claim 12 wherein said control box is located with respect to said burner box so that said fins extend laterally beyond said burner box.

16. The cooking appliance of claim 12 wherein said fins are arranged vertically on said one wall.

17. The cooking appliance of claim 12 wherein said fins are integrally formed on said one wall.

18. The cooking appliance of claim 17 wherein said fins and said one wall are made of a material having a high thermal conductivity.

19. The cooking appliance of claim 18 wherein said fins and said one wall are made of aluminum.

20. In a cooking appliance including control electronics and a burner box having at least one burner assembly disposed therein, a method for cooling said control electronics, said method comprising:

disposing said control electronics in a control box;

locating said control box below said burner box so as to define a gap between said burner box and said control box; and providing fins on said control box so as to cool said control electronics by natural convection.

21. The method of claim 20 further comprising mounting said control electronics on said one wall.

22. The method of claim 20 further comprising locating said control box with respect to said burner box so that said fins extend laterally beyond said burner box.

23. The method of claim 20 further comprising arranging said fins vertically on said one wall.

* * * * *